US007659824B2

(12) United States Patent
Prodanovich et al.

(10) Patent No.: US 7,659,824 B2
(45) Date of Patent: Feb. 9, 2010

(54) SANITIZER DISPENSERS WITH COMPLIANCE VERIFICATION

(75) Inventors: Timothy Prodanovich, Boulder, CO (US); Stephan Jerome Heim, Louisville, CO (US)

(73) Assignee: Resurgent Health & Medical, LLC, Golden, CO (US)

( * ) Notice: Subject to any disclaimer, the term of this patent is extended or adjusted under 35 U.S.C. 154(b) by 261 days.

(21) Appl. No.: 11/617,024

(22) Filed: Dec. 28, 2006

(65) Prior Publication Data

US 2008/0100441 A1 May 1, 2008

Related U.S. Application Data

(60) Provisional application No. 60/863,753, filed on Oct. 31, 2006.

(51) Int. Cl.
*G08B 23/00* (2006.01)

(52) U.S. Cl. ..... 340/573.1; 340/572.1

(58) Field of Classification Search ..... 340/573.1, 340/572.1, 540
See application file for complete search history.

(56) References Cited

U.S. PATENT DOCUMENTS

| | | | |
|---|---|---|---|
| 2,325,008 | A | 7/1943 | Gruett |
| 2,386,455 | A | 10/1945 | Green |
| 2,522,928 | A | 9/1950 | Carroll |
| 2,647,801 | A | 8/1953 | Lycan |
| 2,769,547 | A | 11/1956 | Hirsch |
| 2,826,763 | A | 3/1958 | Bass |
| 3,059,815 | A | 10/1962 | Parsons, Jr. |
| 3,081,471 | A | 3/1963 | Newell |
| 3,220,424 | A | 11/1965 | Nelson |
| 3,243,264 | A | 3/1966 | Hickey |
| 3,437,274 | A | 4/1969 | Apri |
| 3,529,774 | A | 9/1970 | Apri |
| 3,639,844 | A | 2/1972 | Karklys |
| 3,647,147 | A | 3/1972 | Cook |
| 3,699,984 | A | 10/1972 | Davis |
| 3,744,149 | A | 7/1973 | Helbling |
| 3,754,559 | A | 8/1973 | Seiwert |
| 3,757,806 | A | 9/1973 | Baaskar et al. |
| 3,817,651 | A | 6/1974 | Law et al. |

(Continued)

FOREIGN PATENT DOCUMENTS

| | | |
|---|---|---|
| DE | 19903079 | 8/2000 |

(Continued)

OTHER PUBLICATIONS

International Search Report for International (PCT) Patent Application No. PCT/US08/61790, mailed Aug. 6, 2008.

(Continued)

*Primary Examiner*—Jeffery Hofsass
(74) *Attorney, Agent, or Firm*—Sheridan Ross, P.C.

(57) ABSTRACT

A system is provided for providing compliance verification of sanitizer use from a sanitizer dispenser. The system provides for identifying individual users of one or more sanitizer dispensers through technologies such as RFID. Individual's use of sanitizer dispensers is monitored to determine compliance with sanitizer use requirements. A compliance report may be generated based on data associated with one or more individuals' use of the sanitizer dispenser(s). Additionally, the sanitizer dispenser may identify containers having authorized sanitizer.

37 Claims, 7 Drawing Sheets

U.S. PATENT DOCUMENTS

| | | | |
|---|---|---|---|
| 3,844,278 | A | 10/1974 | Weider |
| 3,881,328 | A | 5/1975 | Kleimola et al. |
| 3,918,117 | A | 11/1975 | Plante |
| 3,918,987 | A | 11/1975 | Kopfer |
| 3,967,478 | A | 7/1976 | Guinn |
| 3,992,730 | A | 11/1976 | Davis |
| 3,997,873 | A | 12/1976 | Thornton |
| 4,001,599 | A | 1/1977 | Karklys |
| 4,020,856 | A | 5/1977 | Masterson |
| 4,073,301 | A | 2/1978 | Mackinnon |
| 4,120,180 | A | 10/1978 | Jedora |
| 4,137,929 | A | 2/1979 | Grossman |
| 4,219,367 | A | 8/1980 | Cary, Jr. et al. |
| 4,275,385 | A | 6/1981 | White |
| 4,295,233 | A | 10/1981 | Hinkel et al. |
| 4,398,310 | A | 8/1983 | Lienhard |
| 4,402,331 | A | 9/1983 | Taldo et al. |
| 4,453,286 | A | 6/1984 | Wieland |
| 4,496,519 | A | 1/1985 | McGuire |
| 4,509,543 | A | 4/1985 | Livingston et al. |
| 4,601,064 | A | 7/1986 | Shipley |
| 4,606,085 | A | 8/1986 | Davies |
| 4,606,500 | A | 8/1986 | Mussler et al. |
| 4,670,010 | A | 6/1987 | Dragone |
| 4,688,585 | A | 8/1987 | Vetter |
| 4,769,863 | A | 9/1988 | Tegg et al. |
| 4,817,651 | A | 4/1989 | Crisp et al. |
| 4,896,144 | A | 1/1990 | Bogstad |
| 4,916,435 | A | 4/1990 | Fuller |
| 4,921,211 | A | 5/1990 | Novak et al. |
| 4,925,495 | A | 5/1990 | Crisp et al. |
| 4,942,631 | A | 7/1990 | Rosa |
| 4,999,613 | A | 3/1991 | Williamson et al. |
| 5,016,172 | A | 5/1991 | Dessertine |
| 5,031,258 | A | 7/1991 | Shaw |
| 5,060,323 | A | 10/1991 | Shaw |
| 5,074,322 | A | 12/1991 | Jaw |
| RE33,810 | E | 2/1992 | Strieter |
| 5,086,526 | A | 2/1992 | Van Marcke |
| 5,119,104 | A | 6/1992 | Heller |
| 5,184,642 | A | 2/1993 | Powell |
| 5,193,563 | A | 3/1993 | Melech |
| 5,199,118 | A | 4/1993 | Cole et al. |
| 5,202,666 | A | 4/1993 | Knippscheer |
| 5,238,749 | A | 8/1993 | Cueman et al. |
| 5,257,423 | A | 11/1993 | Jacobsen et al. |
| 5,265,628 | A | 11/1993 | Sage et al. |
| 5,291,399 | A | 3/1994 | Chaco |
| 5,340,581 | A | 8/1994 | Tseng et al. |
| 5,387,993 | A | 2/1995 | Heller et al. |
| RE35,035 | E | 9/1995 | Shipley |
| 5,455,851 | A | 10/1995 | Chaco et al. |
| 5,465,082 | A | 11/1995 | Chaco |
| 5,503,840 | A | 4/1996 | Jacobson et al. |
| 5,515,426 | A | 5/1996 | Yacenda et al. |
| 5,548,637 | A | 8/1996 | Heller et al. |
| 5,561,412 | A | 10/1996 | Novak et al. |
| 5,572,195 | A | 11/1996 | Heller et al. |
| 5,594,786 | A | 1/1997 | Chaco et al. |
| 5,601,100 | A | 2/1997 | Kawakami et al. |
| 5,610,589 | A | 3/1997 | Evans et al. |
| 5,633,742 | A | 5/1997 | Shipley |
| 5,670,945 | A | 9/1997 | Applonie |
| 5,689,229 | A | 11/1997 | Chaco et al. |
| 5,695,091 | A | 12/1997 | Winings et al. |
| 5,699,038 | A | 12/1997 | Ulrich et al. |
| 5,702,115 | A | 12/1997 | Pool |
| 5,727,579 | A | 3/1998 | Chardack |
| 5,745,272 | A | 4/1998 | Shipley |
| 5,765,242 | A | 6/1998 | Marciano |
| 5,774,865 | A | 6/1998 | Glynn |
| 5,781,942 | A | 7/1998 | Allen et al. |
| 5,793,653 | A | 8/1998 | Segal |
| 5,808,553 | A | 9/1998 | Cunningham |
| 5,812,059 | A | 9/1998 | Shaw et al. |
| 5,818,617 | A | 10/1998 | Shipley |
| 5,822,418 | A | 10/1998 | Yacenda et al. |
| 5,822,544 | A | 10/1998 | Chaco et al. |
| 5,823,447 | A | 10/1998 | Maybach |
| 5,838,223 | A | 11/1998 | Gallant et al. |
| 5,845,225 | A | 12/1998 | Mosher |
| 5,860,437 | A | 1/1999 | Fernie |
| 5,863,497 | A | 1/1999 | Dirksing |
| 5,870,015 | A | 2/1999 | Hinkel |
| 5,900,067 | A | 5/1999 | Jones |
| 5,900,801 | A | 5/1999 | Heagle et al. |
| 5,924,148 | A | 7/1999 | Flowers, Sr. |
| 5,939,974 | A | 8/1999 | Heagle et al. |
| 5,945,068 | A | 8/1999 | Ferone |
| 5,945,910 | A | 8/1999 | Gorra |
| 5,952,924 | A | 9/1999 | Evans et al. |
| 5,954,069 | A | 9/1999 | Foster |
| 5,966,573 | A | 10/1999 | Yu et al. |
| 5,966,753 | A | 10/1999 | Gauthier et al. |
| 5,972,126 | A | 10/1999 | Fernie |
| 5,979,500 | A | 11/1999 | Jahrling et al. |
| 5,992,430 | A | 11/1999 | Chardack et al. |
| 6,029,600 | A | 2/2000 | Davis |
| 6,031,461 | A | 2/2000 | Lynn |
| 6,037,871 | A | 3/2000 | Babylon |
| 6,038,331 | A | 3/2000 | Johnson |
| 6,038,519 | A | 3/2000 | Gauthier et al. |
| 6,110,292 | A | 8/2000 | Jewett et al. |
| 6,125,482 | A | 10/2000 | Foster |
| 6,131,587 | A | 10/2000 | Chardack et al. |
| 6,147,607 | A | 11/2000 | Lynn |
| 6,161,227 | A | 12/2000 | Bargenquast |
| 6,176,941 | B1 | 1/2001 | Jewett et al. |
| 6,195,588 | B1 | 2/2001 | Gauthier et al. |
| 6,211,788 | B1 | 4/2001 | Lynn et al. |
| 6,232,870 | B1 | 5/2001 | Garber et al. |
| 6,235,351 | B1 | 5/2001 | DiMarzio et al. |
| 6,236,317 | B1 | 5/2001 | Cohen et al. |
| 6,236,953 | B1 | 5/2001 | Segal |
| 6,268,797 | B1 | 7/2001 | Berube et al. |
| 6,278,372 | B1 | 8/2001 | Velasco, Jr. et al. |
| 6,317,717 | B1 | 11/2001 | Lindsey et al. |
| 6,335,686 | B1 | 1/2002 | Goff et al. |
| 6,344,794 | B1 | 2/2002 | Ulrich et al. |
| 6,351,866 | B1 | 3/2002 | Bragulla |
| 6,392,546 | B1 | 5/2002 | Smith |
| 6,399,853 | B1 | 6/2002 | Roe et al. |
| 6,404,837 | B1 | 6/2002 | Thompson et al. |
| 6,413,921 | B1 | 7/2002 | Childers et al. |
| 6,417,773 | B1 | 7/2002 | Vlahos et al. |
| 6,424,262 | B2 | 7/2002 | Garber et al. |
| 6,426,701 | B1 | 7/2002 | Levy et al. |
| 6,431,189 | B1 | 8/2002 | Deibert |
| 6,448,886 | B2 | 9/2002 | Garber et al. |
| 6,462,656 | B2 | 10/2002 | Ulrich et al. |
| 6,486,780 | B1 | 11/2002 | Garber et al. |
| 6,523,193 | B2 | 2/2003 | Saraya |
| 6,524,390 | B1 | 2/2003 | Jones |
| 6,539,393 | B1 | 3/2003 | Kabala |
| 6,542,568 | B1 | 4/2003 | Howes, Jr. et al. |
| 6,577,240 | B2 | 6/2003 | Armstrong |
| 6,600,420 | B2 | 7/2003 | Goff et al. |
| 6,663,719 | B2 | 12/2003 | Shinozaki et al. |
| 6,671,890 | B2 | 1/2004 | Nishioka |
| 6,706,243 | B1 | 3/2004 | Sias et al. |
| 6,707,873 | B2 | 3/2004 | Thompson et al. |
| 6,727,818 | B1 | 4/2004 | Wildman et al. |
| 6,733,595 | B1 | 5/2004 | Grillo |
| 6,759,959 | B2 | 7/2004 | Wildman |

| | | | |
|---|---|---|---|
| 6,768,419 | B2 | 7/2004 | Garber et al. |
| 6,825,763 | B2 | 11/2004 | Ulrich et al. |
| 6,832,916 | B2 | 12/2004 | Collopy |
| 6,882,278 | B2 | 4/2005 | Winings et al. |
| 6,883,563 | B2 | 4/2005 | Smith |
| 6,892,143 | B2 | 5/2005 | Howes, Jr. et al. |
| 6,902,397 | B2 | 6/2005 | Farrell et al. |
| 6,938,282 | B2 | 9/2005 | Yamamoto |
| 6,956,498 | B1 | 10/2005 | Gauthier et al. |
| 6,970,574 | B1 | 11/2005 | Johnson |
| D512,648 | S | 12/2005 | Smith et al. |
| 6,975,231 | B2 | 12/2005 | Lane et al. |
| 6,992,561 | B2 | 1/2006 | Sandt et al. |
| 7,010,369 | B2 | 3/2006 | Borders et al. |
| 7,015,816 | B2 | 3/2006 | Wildman et al. |
| 7,020,508 | B2 | 3/2006 | Stivoric et al. |
| 7,080,061 | B2 | 7/2006 | Kabala |
| 7,107,631 | B2 | 9/2006 | Lang et al. |
| 7,113,094 | B2 | 9/2006 | Garber et al. |
| 7,119,688 | B2 | 10/2006 | Wildman |
| 7,120,800 | B2 | 10/2006 | Ginter et al. |
| 7,123,151 | B2 | 10/2006 | Garber et al. |
| 7,150,293 | B2 | 12/2006 | Jonte |
| 7,174,577 | B2 | 2/2007 | Jost et al. |
| 7,242,306 | B2 | 7/2007 | Wildman et al. |
| 7,242,307 | B1 | 7/2007 | LeBlond et al. |
| 7,248,933 | B2 | 7/2007 | Wildman |
| 7,270,268 | B2 | 9/2007 | Garber et al. |
| 7,423,533 | B1 | 9/2008 | LeBlond et al. |
| 7,443,305 | B2 | 10/2008 | Verdiramo |
| 2002/0019709 | A1 | 2/2002 | Segal |
| 2002/0104083 | A1 | 8/2002 | Hendricks et al. |
| 2002/0135486 | A1 | 9/2002 | Brohagen et al. |
| 2002/0175182 | A1 | 11/2002 | Matthews |
| 2003/0069815 | A1 | 4/2003 | Eisenberg et al. |
| 2003/0089771 | A1 | 5/2003 | Cybulski et al. |
| 2003/0197122 | A1 | 10/2003 | Faiola et al. |
| 2004/0083547 | A1 | 5/2004 | Mercier |
| 2004/0133081 | A1 | 7/2004 | Teller et al. |
| 2004/0150527 | A1 | 8/2004 | Harper et al. |
| 2004/0255409 | A1 | 12/2004 | Hilscher et al. |
| 2005/0134465 | A1 | 6/2005 | Rice et al. |
| 2005/0136949 | A1 | 6/2005 | Barnes |
| 2005/0139239 | A1 | 6/2005 | Prae |
| 2005/0147526 | A1 | 7/2005 | Hishida |
| 2005/0151641 | A1 | 7/2005 | Ulrich et al. |
| 2005/0171634 | A1 | 8/2005 | York et al. |
| 2005/0248461 | A1 | 11/2005 | Lane et al. |
| 2006/0122474 | A1 | 6/2006 | Teller et al. |
| 2006/0132316 | A1 | 6/2006 | Wildman et al. |
| 2006/0214788 | A1 | 9/2006 | Ku et al. |
| 2006/0224051 | A1 | 10/2006 | Teller et al. |
| 2006/0229891 | A1 | 10/2006 | Grier |
| 2006/0231568 | A1 | 10/2006 | Lynn et al. |
| 2006/0241396 | A1 | 10/2006 | Fabian et al. |
| 2006/0264730 | A1 | 11/2006 | Stivoric et al. |
| 2007/0008146 | A1 | 1/2007 | Taylor et al. |
| 2007/0011893 | A1 | 1/2007 | Garber et al. |
| 2007/0020212 | A1 | 1/2007 | Bernalet et al. |
| 2007/0247316 | A1 | 10/2007 | Wildman et al. |
| 2007/0257803 | A1 | 11/2007 | Munro et al. |
| 2007/0273525 | A1 | 11/2007 | Garber et al. |
| 2008/0001763 | A1 | 1/2008 | Raja et al. |
| 2008/0031838 | A1 | 2/2008 | Bolling |

FOREIGN PATENT DOCUMENTS

| | | |
|---|---|---|
| EP | 0396039 | 11/1990 |
| EP | 0616658 | 9/1994 |
| EP | 0758702 | 2/1997 |
| EP | 1872802 | 1/2008 |
| EP | 1935515 | 6/2008 |
| FR | 2659217 | 9/1991 |
| GB | 2324397 | 10/1998 |
| JP | 5-329065 | 12/1993 |
| WO | WO 80/01983 | 10/1980 |
| WO | WO 93/10311 | 5/1993 |
| WO | WO 03/086274 | 10/2003 |

OTHER PUBLICATIONS

Written Opinion for International (PCT) Patent Application No. PCT/US08/61790, mailed Aug. 6, 2008.
U.S. Appl. No. 11/617,177, Glenn, filed Dec. 28, 2006.
U.S. Appl. No. 11/689,582, Barnhill, filed Mar. 22, 2007.
U.S. Appl. No. 11/829,764, Barnhill, filed Jul. 27, 2007.
U.S. Appl. No. 11/829,769, Barnhill, filed Jul. 27, 2007
U.S. Appl. No. 11/829,775, Barnhill, filed Jul. 27, 2007.
U.S. Appl. No. 11/829,781, Barnhill, filed Jul. 27, 2007.
U.S. Appl. No. 11/829,783, Barnhill, filed Jul. 27, 2007.
U.S. Appl. No. 11/852,099, Glenn, filed Sep. 7, 2007.
Search Results, Mar. 2007, 27 pages.
"Case Study: FL hospital used IT to monitor hand washing", FierceHealthIT website, dated Aug. 3, 2009, available at http://www.fiercehealthit.com/node/8503/print, printed on Aug. 11, 2009, page 1.
"Michigan It Companies Helping the University of Miami Center for Patient Safety Tackle a Leading Cause of Death Using an RTLS Solution to Monitor Staff Hand-Washing Compliance", prnewswire website, dated Jul. 29, 2009, available at hhtp://news.prnewswire.com/DisplayReleaseContent.aspx?ACCT=104&STORY=/www/story/07-29-2009/000506898&EDATE, printed on Aug. 10, 2009, pp. 1-2.
"Hygreen The Intelligent Hand Hygiene Solution", Xhale, Inc., date unknown, 2 pages.
"HyGreen: How it Works",available at http://www.xhale.com/hygreen/solution/How.asp,printed Jul. 14, 2009, pp. 1-2.
"HyGreen: Sample Reporting",available at http://www.xhale.com/hygreen/solution/Reporting.asp,printed Jul. 14, 2009, pp. 1-3.
"HandGiene" available at http://handgienecorp.com/index.jsp, printed Nov. 2, 2009, pp. 1- 2.

SANITIZER DISPENSER-USE RECORD 336

| EMPLOYEE NAME (400) | TIME STAMP (404) | DATE (412) | COMPLIANCE (416) |
|---|---|---|---|
| Janet Smith | 08:00:00 a.m. | 5/21/2006 | Y |
| Bill Powers | 09:00:23 a.m. | 5/21/2006 | N |
| Jason Williams | 10:07:40 a.m. | 5/21/2006 | Y |
| Judy Jones | 11:10:05 a.m. | 5/21/2006 | Y |
| Sandra Collins | 11:20:31 a.m. | 5/21/2006 | N |

Fig. 4

EMPLOYEE RECORD 340

| EMPLOYEE NAME (500) | SANITIZING STATISTICS (504) | ALLERGY (516) |
|---|---|---|
| Sandra Collins | 94% | None |
| Bill Forbes | 97% | Sanitizer A |
| Jane Givens | 91% | None |
| Judy Jones | 99% | None |
| Bill Powers | 85% | None |
| Janet Smith | 95% | None |
| Jason Williams | 90% | None |

Fig. 5

| 700 EMPLOYEE | 704 TIME | 708 DATE | 712 SANITIZER DISPENSER ID | 716 COMPLIANCE VERIFIED? |
|---|---|---|---|---|
| Janet Smith | 8:00 a.m. | 5/21/2006 | A | Y |
| Bill Powers | 9:00 a.m. | 5/21/2006 | A | N |
| Bill Forbes | 10:00 a.m. | 5/21/2006 | C | N |
| Jason Williams | 10:07 a.m. | 5/21/2006 | A | Y |
| Jane Givens | 10:30 a.m. | 5/21/2006 | D | N |
| Judy Jones | 11:10 a.m. | 5/21/2006 | A | Y |
| Sandra Collins | 11:20 a.m. | 5/21/2006 | A | Y |

Fig. 7

SANITIZER DISPENSERS WITH COMPLIANCE VERIFICATION

CROSS REFERENCE TO RELATED APPLICATION

The present application claims the benefit of U.S. Provisional Patent Application No. 60/863,753 filed on Oct. 31, 2006, and entitled "AUTOMATED WASHING SYSTEM WITH COMPLIANCE VERIFICATION", the entire content of which is incorporated herein by reference in its entirety for all purposes.

FIELD

The present invention relates to a compliance verification system for sanitizer dispensers.

BACKGROUND

The importance of cleanliness has long been recognized, particularly in the fields of heath-care, food preparation, and laboratories, to name but a few. Although traditional hand washing using soap and water is performed by most people, these same people are often unwittingly exposed to unsanitary conditions after washing their hands. For example, people are potentially exposed to unsanitary surfaces by touching a handrail of a stairway or escalator, and/or when opening doors, handling currency, touching keyboards, etc. Thus, sanitizer dispensers are used in a wide variety of settings to provide people with a sanitizing material to rub on their hands prior to undertaking activities where cleanliness is important, such as prior to eating, handling food, or attending to a patient at a health care facility. Of course, sanitizer dispensers are also used at remote locations, such as at construction sites, temporary emergency care locations or large public gatherings where soap and water are not always readily available.

One difficulty with attempting to provide sanitary conditions is that people do not always wash their hands and/or use a sanitizer material when they should. For example, health care staff and/or patient visitors do not always have clean hands when visiting or attending to a patient. As a further example, people in the food service industry do not always have clean hands when undertaking their food preparation duties. Even when sanitizer dispensers are available, the intended user, such as health care staff or food preparation workers, do not necessarily use the sanitizer dispensers when they should. Thus, for those situations or settings where users are required by a rule or requirement to use a sanitizer, it would be advantageous in such situations to provide a verification system to monitor user compliance.

A further difficulty with attempting to provide sanitary conditions is that an improper substance may be loaded into a sanitizer dispenser. Thus, it would be advantageous to provide a system of monitoring whether an authorized sanitizer container has been installed in a sanitizer dispenser.

SUMMARY

In accordance with embodiments of the present invention, a Radio Frequency Identification ("RFID") or other electronically readable indentifier system is disclosed for use in connection with one or more sanitizer dispensers. The system is operable to record and report on user compliance with sanitizer use requirements. In addition, the system has the capability to ensure that an authorized consumable sanitizer, such as an alcohol gel, is used in the sanitizer dispenser.

In accordance with one or more embodiments described herein, the user carries or wears an RFID tag (or other automatically detectable identification device) that is specific to the individual. Upon approaching a sanitizer dispenser, an RFID reader recognizes the user's tag and records the user name, time, date, sanitizer dispenser location/ID, and may also record whether the dispenser was cycled. The data is stored in the readers' database until captured via various methods and transferred into a report format for an administrator. The administrator can then review the compliance statistics for the various users.

In a separate aspect of the invention, and in accordance with one or more embodiments described herein, the RFID system is well suited to monitoring whether a consumable item used in the sanitizer dispenser, such as a sanitizing alcohol gel, is authentic or unauthorized. An RFID tag is attached to the consumable product, such as a bag or bottle containing an alcohol gel. When installed in the sanitizer dispenser, the tag attached to the sanitizer container bag or bottle will confirm to the RFID system by way of the unique tag identifier that the subject bottle is an authorized sanitizer. Upon detection of an improper consumables item, the administrator may be notified, or another action may be taken. For example, the dispenser's plunger is deactivated in some manner, such as by triggering a locking pin into the dispenser's plunger. In another example, a warning device, such an audible and/or visual alarm is activated. Without this verification, a user of the sanitizer dispenser may advertently or inadvertently use an unauthorized solution that is harmful or ineffective as a sanitizer. Another benefit is that an authorized sanitizer will be at the correct viscosity to ensure that an adequate sanitizer amount is dispensed when the dispenser plunger is cycled, and/or to ensure that the plunger opening does not become plugged from an improper material loaded into the sanitizer dispenser. Another benefit is that the maintenance history for the sanitizer dispenser can be electronically, optically, and/or magnetically recorded for later review. The RFID tag on each consumables container can not only indicate the type and/or composition of the additive, but also the container size (volume). The computer tracking system can record the RFID tag indentifier and time stamp when it was read.

Various embodiments of the present invention are set forth in the attached figures and in the detailed description of the invention as provided herein and as embodied by the claims. It should be understood, however, that this Summary does not contain all of the aspects and embodiments of the present invention, is not meant to be limiting or restrictive in any manner, and that the invention as disclosed herein is and will be understood by those of ordinary skill in the art to encompass obvious improvements and modifications thereto.

Additional advantages of the present invention will become readily apparent from the following discussion, particularly when taken together with the accompanying drawings.

BRIEF DESCRIPTION OF THE DRAWINGS

FIG. 4 is an exemplary sanitizer dispenser-use record in accordance with embodiments of the present invention;

FIG. 5 is an exemplary employee record in accordance with embodiments of the present invention;

FIG. 7 is an exemplary compliance report in accordance with embodiments of the present invention.

DETAILED DESCRIPTION

The present invention is directed to a system and method for ensuring user (e.g., employee) compliance with sanitizer use requirements. In accordance with embodiments of the present invention, employee use of one or more sanitizer dispensers is monitored. The sanitizer dispensers operate to dispense a sanitizer, such as an alcohol gel or alcohol mist, when a person activates the sanitizer dispenser, such as by pushing a plunger or triggering an infrared sensor to automatically activate ejection of the sanitizer when a person places one or both of their hands adjacent the sanitizer dispenser. Thus, as used herein, a "sanitizer dispenser" means a device that dispenses a sanitizer, whether manually (e.g., by pressing a button or plunger) or automatically (e.g, by a battery powered pump in a touchless sanitizer dispenser). In addition, as used herein, "sanitizer" refers to a fluid, whether a liquid, gas, or pseudo-solid (such as a semi-solid or gel) that includes one or more antimicrobial and/or cleaning agents. The antimicrobial agent can kill organisms such as bacteria, protozoa, and/or viruses. Sanitizer use requirements may vary depending upon the nature of the person's work. For example, employees may be instructed to use a sanitizer upon entering a patient's room or just prior to attending their food service work station. In such exemplary situations, rules may be in place for use of a sanitizer prior to performing work in the patient's room or prior to handling utensils or tools at a food service work station. For such situations, embodiments of the present invention allow monitoring and verification of employee compliance with sanitizer use requirements. Accordingly, the sanitizer dispensers are operable to record and report data related to employee compliance with such requirements.

Figure 1:
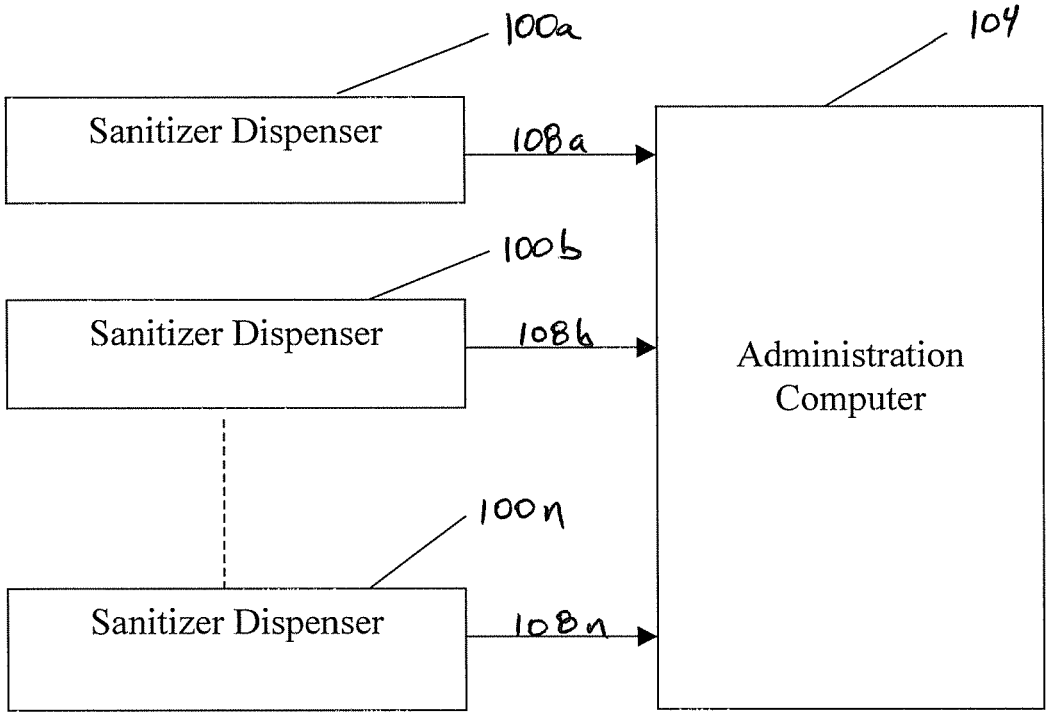
FIG. 1 is a block diagram of components that may be included in embodiments of the present invention.

Referring now to FIG. 1, components of a compliance system in accordance with embodiments of the present invention are illustrated in block diagram form. Shown in FIG. 1 is a plurality of sanitizer dispensers 100*a*, 100*b* . . . 100*n*. The sanitizer dispensers 100*a*-100*n* may be used by people employed at a facility that requires employees to use a sanitizer on their hands. Such facilities may include, for example, restaurants, food processing facilities, hospitals and laboratories. Also shown in FIG. 1 is an administration computer 104 for use by a manager or administrator of the facility. The administration computer 104 is operable to generate a compliance report as described herein.

The administration computer 104 communicates with the one or more sanitizer dispensers 100*a*-100*n* over a plurality of communication links 108*a*, 108*b* . . . 108*n*. The communication links may be implemented by any one of a variety of methods and may depend on the type of facility in which the sanitizer dispensers 100*a*-100*n* are used. In particular, the communication links 108*a*-108*n* may be implemented as part of a local area network (LAN) or a wide area network (WAN). More particularly, the communication links 108*a*-108*n* may be implemented using such protocols as Ethernet or USB. The communications links 108*a*-108*n* may be implemented as wired or wireless connections. It may be the case that the administration computer 104 is located in a separate facility from one or more of the sanitizer dispensers 100*a*-100*n*. In this case, a distributed data processing network such as the Internet may form part of the communication links 108*a*-108*n*.

Figure 2:
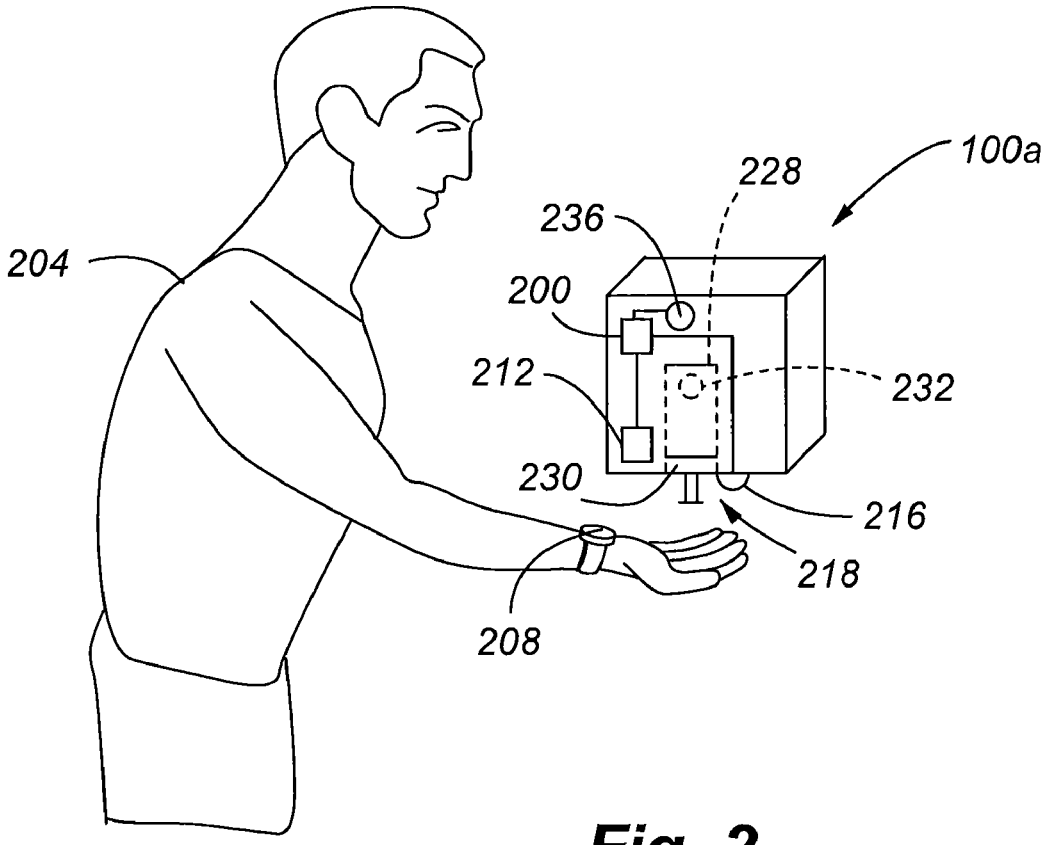
FIG. 2 is a schematic depiction of a sanitizer dispenser in accordance with embodiments of the present invention.

Referring now to FIG. 2, an exemplary sanitizer dispenser 100*a* is illustrated. The sanitizer dispenser 100*a* includes a sanitizer dispenser operations monitor 200. The sanitizer dispenser operations monitor 200 is a computational device such as a general purpose computer, controller, or ASIC that is operable to record data associated with employee use of the sanitizer dispenser 100*a* and to report the data to the administration computer 104. The sanitizer dispenser operations monitor 200 may be incorporated into the sanitizer dispenser 100*a* (if an automated dispenser) or, alternatively, may be implemented as a separate computing device.

Also shown in FIG. 2 is a user 204 of the sanitizer dispenser 100*a*. The user 204 may be an employee or visitor who is required to use a sanitizer because of the nature of their work or the nature of the facility. The user 204 is shown wearing a user RFID tag 208. The user RFID tag 208 is programmed by an RFID tag programming device (not shown) with information such as an employee number that, when read, uniquely identifies the employee. The RFID tag 208 may be incorporated into an identification badge or bracelet worn by the user 204.

In accordance with embodiments of the present invention, the sanitizer dispenser 100*a* includes an RFID reader 212. The RFID reader 212 is positioned so as to be able to read the user RFID tag 208 when the user 204 is obtaining sanitizer at a sanitizer dispenser 100*a*. The RFID reader 212 may be incorporated into the sanitizer dispenser 100*a* or, alternatively, may be implemented as a stand-alone device. For example, the RFID reader 212 may be positioned adjacent to the sanitizer dispenser 100*a*.

In a separate aspect of the present invention, the sanitizer dispenser 100*a* may optionally include a use verifier, such as an optical sensor 216 positioned so as to be able to sense whether the user 204 actually positioned at least one of their hands for properly receiving a dose of sanitizer. For example, a battery powered optical sensor 216 may be placed adjacent a plunger 218 that is depressed by the user 204 to obtain sanitizer from the sanitizer dispenser 100*a*. Alternatively, the optical sensor 216 may serve as both a use verifier and as a trigger for the sanitizer dispenser. For example, in touchless sanitizer dispensers the optical sensors 216 serve to trigger the sanitizer dispenser to deliver a dose of sanitizer by an electric pump or atomizer. For such sanitizer dispensers, the optical sensor 216 may also serve as the optical sensor for monitoring the position of the user's hands and reporting to the administration computer 104 whether, and optionally for how long, the person actually held their hand(s) to receive a dosage of sanitizer, and thus, that the person was not just located near the sanitizer dispenser 100*a*. Alternatively yet, other ways of monitoring whether the sanitizer dispenser 100*a* has been used are also within the scope of the invention. For example, as those skilled in the art will appreciate, the plunger 218 or other dispensing device associated with the sanitizer dispenser 100*a* may include a trip/cycle indicator (not shown) for registering whether the plunger 218 was actually depressed or otherwise triggered.

The RFID reader 212 and the optical sensor 216 (if present) are in communication with sanitizer dispenser operations monitor 200, which, in turn, is operable to collect data associated with these devices. More particularly, data is collected from the RFID reader 212 indicating the identity of the user 204. Additionally, if the sanitizer dispenser 100*a* includes a use verifier, such as an optical sensor 216, data from the use verifier is also collected by the sanitizer dispenser operations monitor 200. As those skilled in the art will appreciate, in addition to RFID, other magnetically, optically, and/or electronically readable user identifiers are within the scope of the present invention. In particular, a user may be identified by way of a typed password, retinal scan, voice print, palm print, fingerprint, face identification, bar coding (on an employee ID), etc.

Also shown in FIG. 2 is a consumables container 228 that contains the sanitizing material, such as an alcohol gel. In accordance with at least one embodiment of the present invention, the consumables container 228 may optionally include a detachable connection to a consumable receptacle 230 associated with the sanitizer dispenser 100*a* so that the consumable container 228 may be removed and disposed of when its contents are expended. After the disposal of a used consumables container 228, a new consumables container 228 is then attached to the sanitizer dispenser 100*a*. In accordance with one or more embodiments of the present invention, the consumables container 228 also includes a consumables RFID tag 232 that contains information related to the consumable container 228. A consumables RFID reader 236 associated with the sanitizer dispenser 100*a* reads the consumables RFID tag 232 and communicates information related to the consumables container 228 to the sanitizer dispenser operations monitor 200. In one embodiment of the present invention, the RFID reader 212 can also serve as the consumables RFID reader 236 so that two separate readers are not need. However, two separate readers could be used. In addition, although RFID is discussed herein for use of identification of consumables, as noted herein other types of identification systems may be used, such as bar codes. Thus, for example, if RFID is used to identify the user, and a bar code is used to identify the consumables, or vice-versa, two separate readers may be needed.

Figure 3:
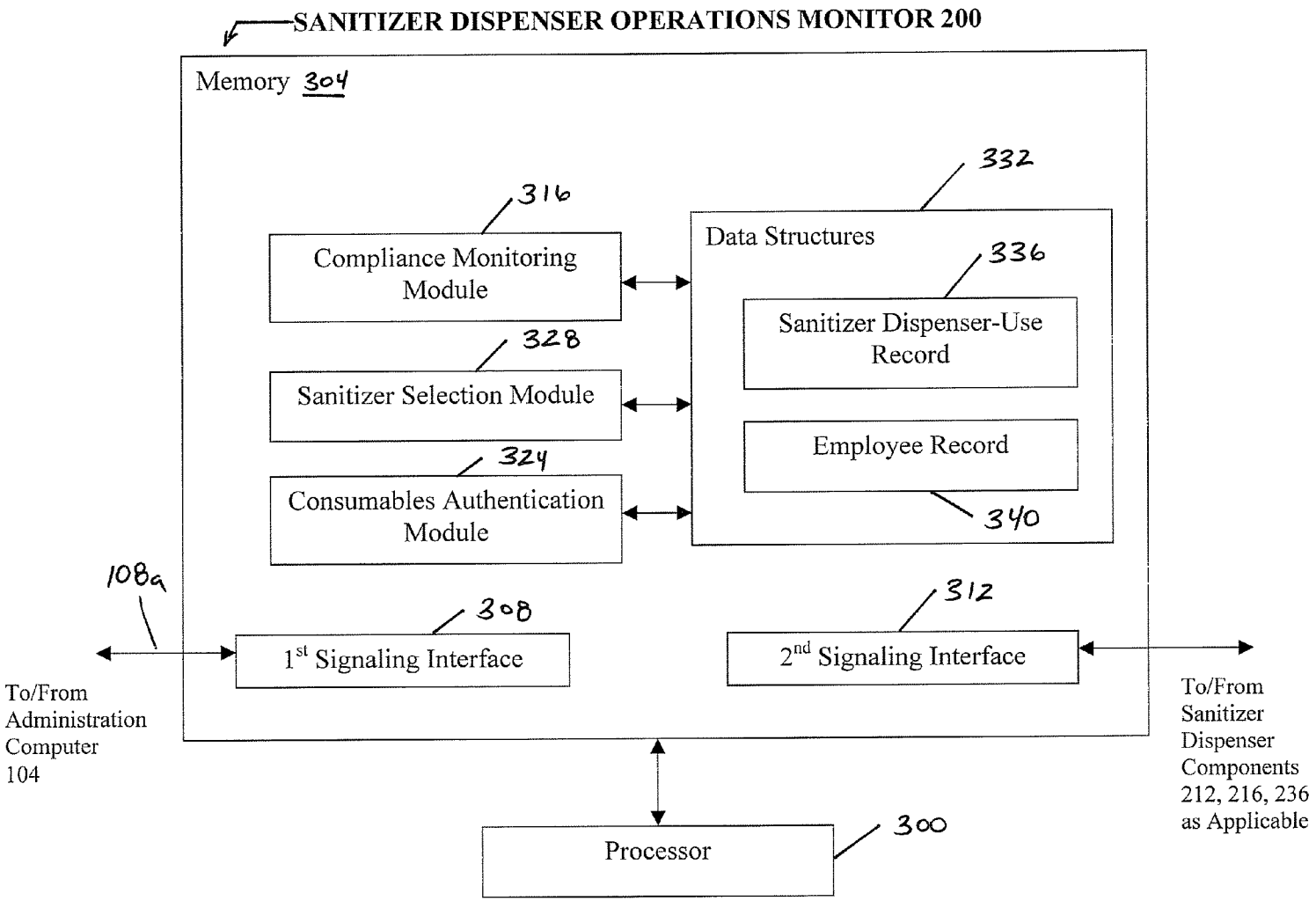
FIG. 3 is a block diagram of a sanitizer dispenser operations monitor in accordance with embodiments of the present invention.

Referring now to FIG. 3, a block diagram of components and features of the sanitizer dispenser operations monitor 200 is shown. As mentioned previously, the sanitizer dispenser monitor 200 is a computational device. Accordingly, the sanitizer dispenser operations monitor 200 includes a processor 300, a memory 304 and signaling interfaces 308 and 312 operable to communicate with external electronic and/or computational components. The first signaling interface 308 operates to communicate with the administration computer 104 over communication link 108*a*, as described above. The second signaling interface 312 operates to communicate with the various electronic components associated with the compliance verification system for sanitizer dispenser 100*a*, including: (1) the RFID reader 212 for the user's RFID tag 208; (2) the optional RFID reader 236 for the consumables RFID tag 232 (although in one embodiment a single RFID reader may be used to serve as the RFID reader for the user's RFID tag 208 and also the consumables RFID tag 232); and (3) the optional use verifier, such as optical sensor 216. The second signaling interface 312 may be a portion of a backplane incorporated into sanitizer dispenser 100*a* that includes a connection to the sanitizer dispenser's 100*a* electronic components, if any. Alternatively, if sanitizer dispenser 100*a* is a manually operated unit and/or if the sanitizer dispenser operations monitor 200 is implemented as a stand-alone computer, the sanitizer dispenser operations monitor 200 may communicate with the electronic components associated with the compliance verification system for sanitizer dispenser 100*a* through a network or serial bus connection.

The memory 304 includes a plurality of stored program applications or modules that implement various features of a compliance monitoring system. In accordance with embodiments of the present invention, the memory 304 includes a compliance-monitoring module 316 and optionally includes a consumables authentication module 324. Additionally, the memory 304 may include data structures 332 associated with the various modules. In accordance with embodiments of the present invention, the data structures 332 include a sanitizer dispenser-use record 336 and one or more employee records 340. The operation of the various modules and data structures is described in greater detail below.

The compliance-monitoring module 316 operates to monitor and record the activity of a plurality of users 204 of the sanitizer dispenser 100*a*. The process is outlined as follows. The user 204 approaches a sanitizer dispenser 100*a* with a RFID tag 208 on their person, the RFID tag 208 having been programmed with a RFID tag programming device with the individual's name or number, and/or other pertinent data. The tag 208 is read by the RFID reader 212 when the user 204 approaches and/or activates the sanitizer dispenser 100*a*. In addition, for embodiments including a use verifier, for example an optical sensor 216, as the user 204 places at least one of his or her hands in the proximity of the dispensing device of the sanitizer dispenser 100*a* the optical sensor 216 will register within the data structure 332 that the user 204 used the sensitizer dispenser 100*a*. In at least some touchless sanitizer dispensers, the sensor activating the sanitizer dispenser 100*a* to eject sanitizer may also serve as the use verifier (e.g., an infrared sensor that triggers ejection of the sanitizer also is the optical sensor 216 that provides data of use to the data structure 332). In one configuration, a timer records a time duration during which the optical and/or infrared sensor determines that the user's hands are in a position to receive sanitizer. After a user 204 has used the sanitizer dispenser 100*a*, the data showing such items as user name, time, use-time interval, date, sanitizer dispenser ID, and, optionally, use verification data, etc., is stored in the data structure 332. The stored data is later accessed by the administration computer 104 in connection with the generation of a compliance report.

An exemplary sanitizer dispenser-use record 336 having data associated with a plurality of users 204 is shown in FIG. 4. In accordance with embodiments of the present invention, an entry in the sanitizer dispenser-use record 336 may include an employee name 400 indicating who used the sanitizer dispenser 100*a*, a time stamp 404 indicating when the user RFID tag 208 was read, the date 412, and, optionally, a compliance indicator 416 specifying whether or not a use verifier positively registered that the sanitizer dispenser 100*a* actually dispensed sanitizer. As an example, the sanitizer dispenser-use record shown in FIG. 4 indicates that on May 21, 2006 Janet Smith met the sanitizer use requirement by using the sanitizer dispenser at 8:00.00 A.M. In an alternative embodiment, if an optional use verifier is not associated with the sanitizer dispenser 100*a*, the sanitizer dispenser-use record 336 may contain only raw data such as the employee name 400, time 404, and date 412 without a determination as to whether compliance requirements have been met. Alternatively, compliance may be defined by some administrators to consist of the user's identification having been read by the RFID reader 212, and actual use of the sanitizer is assumed and not checked.

The compliance-monitoring module 316 may also operate to monitor sanitizer use requirements that are specific to each employee. Some employees may have stricter sanitizer use requirements than others at the same facility. For example, a hospital emergency room may employ both nurses and social workers. As can be appreciated, the nurses may be required to use sanitizer more frequently than the social workers. Accordingly, the compliance-monitoring module 316 may access employee records to determine the required frequency of sanitizer use for a particular employee. In addition, sanitizer use requirements may also depend on an employee's history of compliance with his or her sanitizer requirements. For example, an employee may be required to use sanitizer more often if a history of previous non-compliance exists.

In accordance with embodiments of the present invention, a sanitizer selection module 328 may be provided to determine what type of sanitizer is to be used with each individual user 204. More particularly, it is generally anticipated that the majority of sanitizer dispensers would only hold one type of sanitizer. However, sanitizer dispensers holding two or more types of sanitizer or a concentrated sanitizer with a diluting agent are contemplated by the present invention. For example, a sanitizer dispenser 100*a* may be equipped with a plurality of different types of sanitizer, and one user 204 may have an allergy to the standard sanitizer, so the system is programmed to automatically use a different and appropriate sanitizer when this user 204 is identified through their RFID tag 208. Alternatively, the sanitizer selection module 328 may determine whether the user 204 should use one or a greater number of doses (i.e., volume) of sanitizer, or different sanitizer formulation, depending upon their job duties. In yet another alternative, the sanitizer selection module 328 may determine the concentration of sanitizer, wherein embodiments of the sanitizer dispensers 100 may comprise a way of diluting a concentrated sanitizer using a diluting agent. Accordingly, information related to user allergies or sanitizer type and/or concentration and/or amount may be contained in the employee record 340.

An exemplary employee record 340 for use in connection with the sanitizer selection module 328 is shown in FIG. 5. In accordance with embodiments of the present invention, an entry in the employee record 340 may include the employee name 500, sanitizer use statistics 504 associated with employee, and/or a listing of the employee's allergies 516. As an example, the employee record 340 shown in FIG. 5 indicates that Bill Forbes is in 97% compliance with the sanitizer use requirement and has an allergy to sanitizer A.

In accordance with embodiments of the present invention, the employee record 340 may be an instance of a global employee record maintained centrally at the administration computer 104. Accordingly, the administration computer 104 may periodically access and/or update a plurality of instances of employee records 340 associated with each sanitizer dispenser 100*a*-100*n* to maintain a comprehensive employee record. Alternatively, at least a portion of the employee use record 340, or data described herein as being associated with the employee use record 340, may be stored in the RFID tag 208 worn by the user 204. For example, a list of the user's 204 allergies may be stored in his or her RFID tag 208 and read by the RFID reader 212 when the user 204 obtains sanitizer from a sanitizer dispenser 100*a*.

Embodiments of the present invention may include operation of a consumables authentication module 324 that operates to recognize when a non-authorized sanitizer is introduced into the system. The consumables container 228 and/or a receptacle or fitting associated with the sanitizer dispenser 100*a* for receiving the consumables container 228 may be mechanically designed to discourage introducing non-authorized sanitizer to the system. In accordance with embodiments of the present invention, the consumables container 228 includes a consumable container RFID tag 232 that is recognized by the RFID reader 236 as an approved sanitizer container. If the consumables container 228 is withdrawn from the sanitizer dispenser 100*a* and reinstalled, the RFID reader 236 will recognize the tag as invalid and warn the administrator through the administration computer 104 via a communication link 108*a* that this is not acceptable and potentially void the product warranty. Alternatively, or in addition thereto, an option is available where the sanitizer dispenser 100*a* will stop functioning at the direction of the consumables authentication module 328 until a proper consumables container 228 with a valid RFID tag 232 is inserted into the sanitizer dispenser container receptacle 230. For example, the dispensing pump or plunger may be rendered inoperative, such as by a shut-down mode for automatic dispensers or a locking pin (not shown) on a manually operated plunger activated dispenser. In yet another possible alternative and/or in addition to the options provided above, the known number of doses or applications (i.e., volume) of the consumable material may be associated with a valid RFID tag 232 and monitored by the consumables authentication module 328 so that once the number of applications is reached (and thus the consumable (sanitizer) expended) the sanitizer dispenser 100*a* cannot be used until another valid consumables container 228 is installed. For example, say that one consumables container 228 contains enough sanitizer for approximately 500 dispensings of sanitizer. Once the sanitizer dispenser 100*a* has administered approximately 500 dispensings of sanitizer (e.g., 510) using a particular consumables container 228, then this container will no longer be operable with the sanitizer dispenser 100*a*. This prevents the consumable container 228 from being removed, refilled with a non-approved sanitizer (or other material), and then reinserted for use with the sanitizer dispenser 100*a*. Such forced compliance for use of the proper consumables provides compliance regulators and/or administrators confidence that approved sanitizer is being applied to the users 204 hands with each use.

In addition to RFID, other methods and/or systems may be used to identify the consumables container 228. For example, the consumable container 228 may be identified by a bar code and bar code reader.

Figure 6:
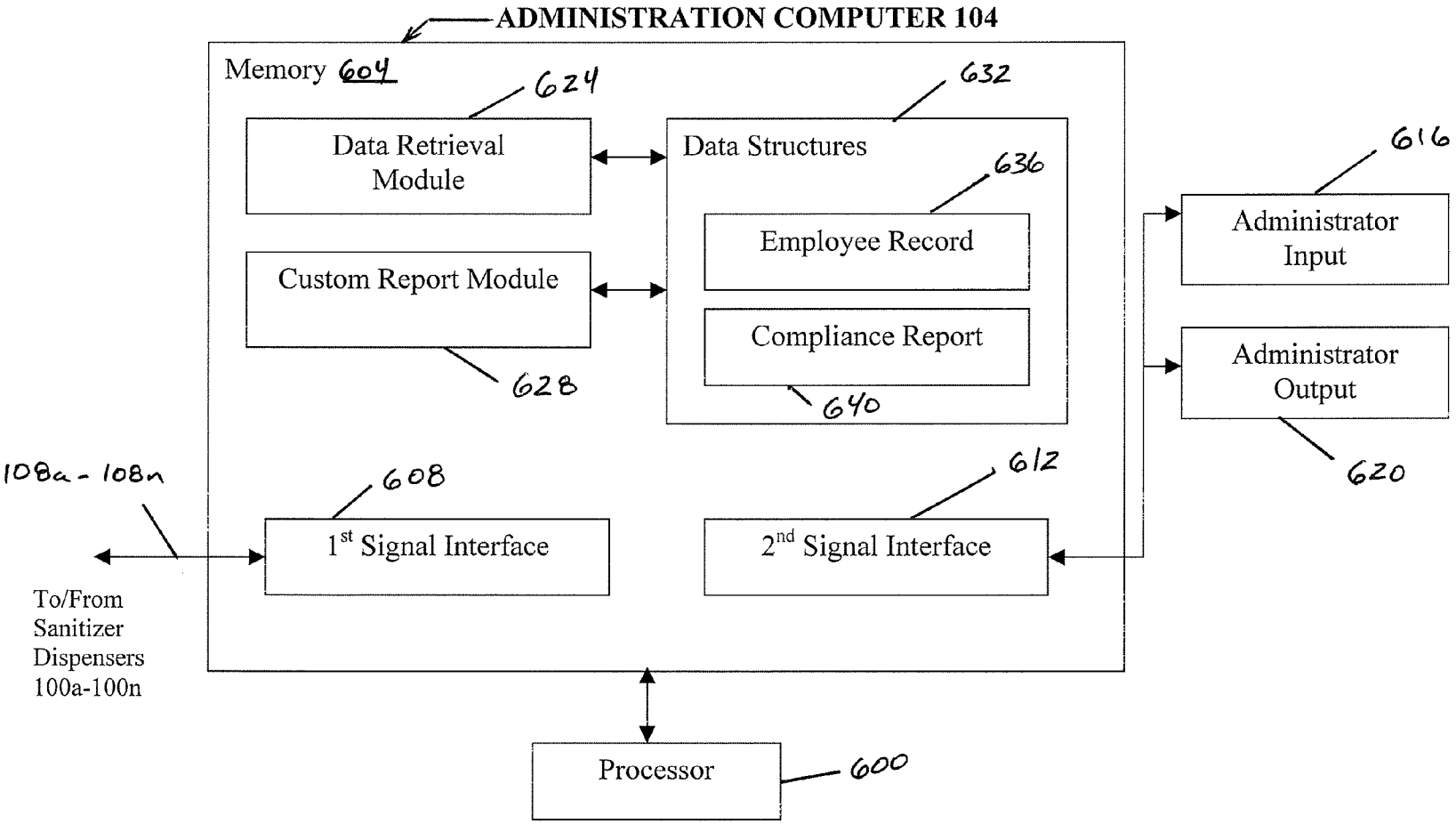
FIG. 6 is a block diagram of an administration computer in accordance with embodiments of the present invention.

Referring now to FIG. 6, a block diagram showing components and features of the administration computer 104 is illustrated. Administration computer 104 includes a processor 600, a memory 604 and signaling interfaces 608 and 612 operable to communicate with external electronic and/or computational components. The first signaling interface 608 operates to communicate with the sanitizer dispensers 100*a*-100*n* over communication links 108*a*-108*n*, as described above. The second signaling interface operates to communicate with the various administrator input 616 and administrator output 620 devices associated with the administration computer 104. The administrator input device 616 may be, for example, a keyboard or a mouse interconnected to the administration computer 104. The administrator output device 620 may be, for example, a monitor or a printer interconnected to the administration computer 104.

The memory 604 includes a plurality of stored program applications or modules that implement various features of a compliance monitoring system. In accordance with embodiments of the present invention, the memory 604 may include a data retrieval module 624 and a custom report module 628. Additionally, the memory 604 may include data structures 632 associated with the various modules. In accordance with embodiments of the present invention, the data structures 632 may include an employee record 636 and/or a compliance report 640.

The data retrieval module 624 operates to retrieve data associated with sanitizer dispensers 100*a*-100*n*. Such data may include data related to sanitizer dispenser usage and/or employee specific data. The data may be contained in a sanitizer dispenser-use record 336 and/or an employee record 340 associated with a sanitizer dispenser 100*a*-100*n*. Additionally, the data retrieval module 624 may operate to maintain a global employee record 636 as described above.

The custom report module 628 operates to generate the compliance report 640. The compliance report 640 is generated from data contained in each sanitizer dispenser-use record 336 associated with sanitizer dispensers 100*a*-100*n*. An exemplary compliance report is shown in FIG. 7. In accordance with embodiments of the present invention, an entry in the compliance report 640 may include an employee name 700, time stamp 704 indicating when a sanitizer dispenser 100*a* was used, the date 708 of the use, the sanitizer dispenser ID 712, and a optionally a compliance indicator 716 specifying whether or not the user 204 met the compliance requirement. As an example, the compliance report shown in FIG. 7 indicates that on May 21, 2006 Janet Smith met the sanitizer use requirement by using a sanitizer dispenser at 8:00.00 A.M at sanitizer dispenser A.

Figure 8:
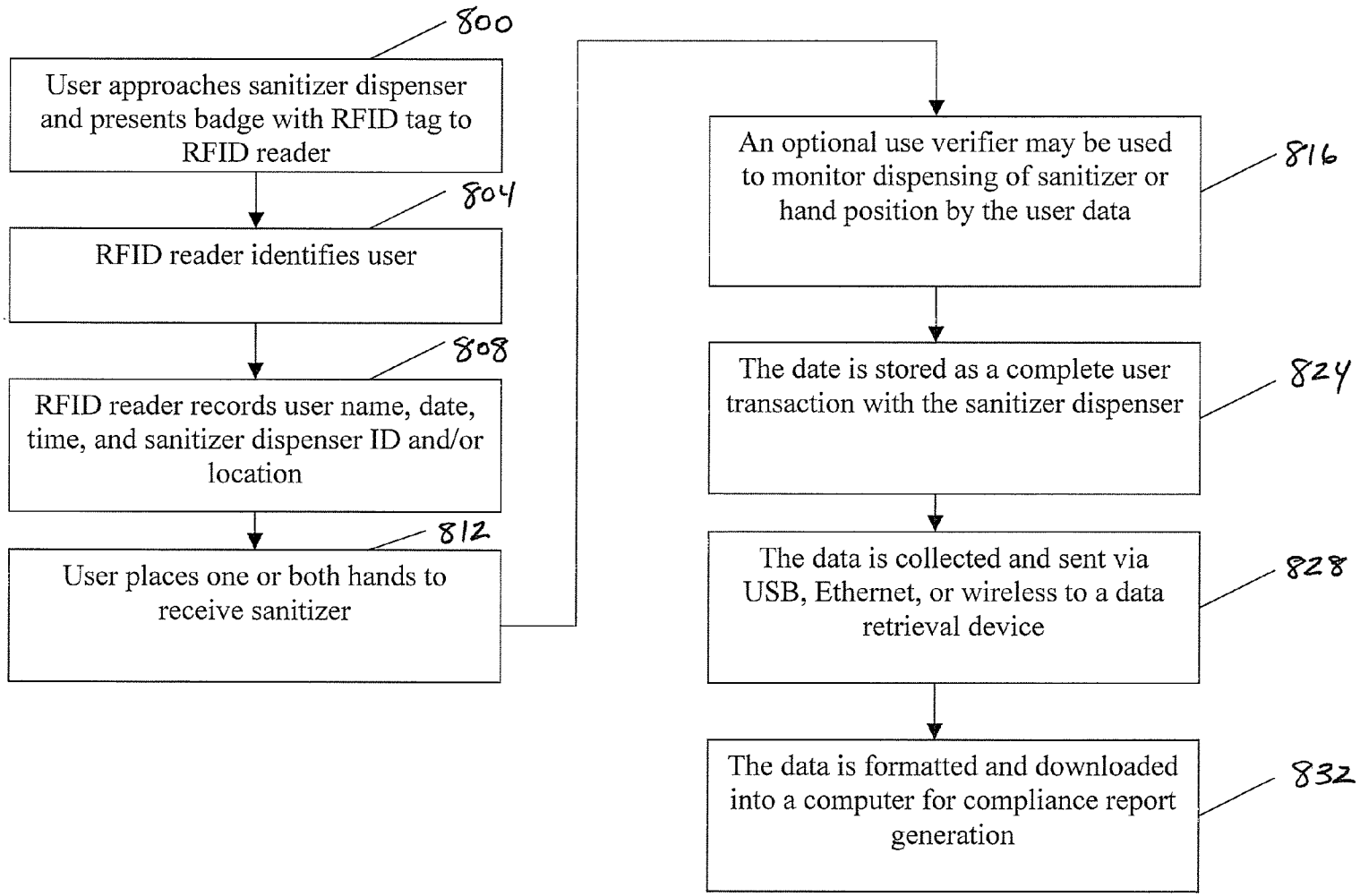
FIG. 8 is a flow chart depicting aspects of a method of monitoring sanitizer use compliance in accordance with embodiments of the present invention. The drawings are not necessarily to scale.

In accordance with embodiments of the present invention, FIG. 8 shows a block diagram illustrating the steps of a method of monitoring a compliance requirement. Initially, at step 800 a user 204 approaches a sanitizer dispenser 100*a* and presents a badge having a RFID tag 208 to an RFID reader 212. At step 804 the RFID tag 208 is read and the user 204 is identified. At step 808 the user's 204 name, the date, the time, and the location or identification number/designation of the sanitizer dispenser 100*a* are recorded. At step 812 sanitizer is dispensed. At optional step 816, compliance verification may occur, such as through an optical sensor 216 to sense the user's hand(s) near the dispensing outlet of the sanitizer dispenser 100*a*. At step 824 the transaction is completed and recorded. At step 828 data is collected from the sanitizer dispensers 100*a*-100*n* over the communication links 108*a*-108*n*. Finally, at step 832 the collected data is used to generate a compliance report 640. Additional steps associated with the method may include: monitoring proper use of consumables; warning that an improper consumables container 228 has been installed; warning that a consumables container 228 is empty or nearly empty based on the number of uses since being installed; and warning that one or more users are failing to meet compliance requirements if a use verifier is used.

The present invention, in various embodiments, includes components, methods, processes, systems and/or apparatus substantially as depicted and described herein, including various embodiments, subcombinations, and subsets thereof. Those of skill in the art will understand how to make and use the present invention after understanding the present disclosure. The present invention, in various embodiments, includes providing devices and processes in the absence of items not depicted and/or described herein or in various embodiments hereof, including in the absence of such items as may have been used in previous devices or processes, e.g., for improving performance, achieving ease and\or reducing cost of implementation.

It is to be noted that the term "a" or "an" entity refers to one or more of that entity. As such, the terms "a" (or "an"), "one or more" and "at least one" can be used interchangeably herein. It is also to be noted that the terms "comprising", "including", and "having" can be used interchangeably.

The foregoing discussion of the invention has been presented for purposes of illustration and description. The foregoing is not intended to limit the invention to the form or forms disclosed herein. In the foregoing Detailed Description for example, various features of the invention are grouped together in one or more embodiments for the purpose of streamlining the disclosure. This method of disclosure is not to be interpreted as reflecting an intention that the claimed invention requires more features than are expressly recited in each claim. Rather, as the following claims reflect, inventive aspects lie in less than all features of a single foregoing disclosed embodiment. Thus, the following claims are hereby incorporated into this Detailed Description, with each claim standing on its own as a separate preferred embodiment of the invention.

Moreover, though the description of the invention has included description of one or more embodiments and certain variations and modifications, other variations and modifications are within the scope of the invention, e.g., as may be within the skill and knowledge of those in the art, after understanding the present disclosure. It is intended to obtain rights which include alternative embodiments to the extent permitted, including alternate, interchangeable and/or equivalent structures, functions, ranges or steps to those claimed, whether or not such alternate, interchangeable and/or equivalent structures, functions, ranges or steps are disclosed herein, and without intending to publicly dedicate any patentable subject matter.

What is claimed is:

1. A system for monitoring sanitizer use, the system comprising:

at least a first sanitizer dispenser operable to dispense sanitizer to a user's hand;

an identification apparatus operatively associated with the first sanitizer dispenser, the identification apparatus being operable to automatically identify at least one of (a) the user, and (b) a first sanitizer container engaged with the first sanitizer dispenser;

a sanitizer dispenser operations monitor operatively associated with the first sanitizer dispenser, the sanitizer dispenser monitor comprising:

a consumables-authentication module in communication with the identification apparatus, the consumables-authentication module operable to obtain an identifier associated with the first sanitizer dispenser and verify that the obtained identifier matches a selected identifier associated with at least one of a sanitizer type, a sanitizer composition, a sanitizer volume, a sanitizer container shape, a sanitizer container size, and a sanitizer concentration.

2. The system as claimed in claim 1, further comprising a compliance module in communication with the identification apparatus, the compliance module being operable to record data associated with use of the first sanitizer dispenser by the user, and wherein the identification apparatus is operable to automatically identify the user, and wherein the sanitizer dispenser operations monitor comprises the compliance module in communication with the identification apparatus.

3. The system as claimed in claim 2, further comprising an administration computer in communication with the sanitizer dispenser operations monitor of the first sanitizer dispenser, the administration computer being operable to generate a compliance report based on at least a portion of the data associated with use of the first sanitizer dispenser.

4. The system as claimed in claim 3, wherein the administration computer is in communication with a plurality of sanitizer dispenser operations monitors of a corresponding plurality of sanitizer dispensers, the plurality of sanitizer dispensers including the first sanitizer dispenser, wherein the compliance report is based on data recorded by the plurality of sanitizer dispenser operations monitors.

5. The system as claimed in claim 2, wherein, for each use of the first sanitizer dispenser, the data associated with the use of the first sanitizer dispenser includes an employee name, a time of sanitizer dispenser use, and a date of sanitizer dispenser use.

6. The system as claimed in claim 5, further comprising a boolean value indicative of user compliance with a sanitizer-use requirement.

7. The system as claimed in claim 2, further comprising a sensor disposed on the first sanitizer dispenser operable to determine if the user's hand is in a position to receive the sanitizer from the first sanitizer dispenser.

8. The system as claimed in claim 7, wherein the compliance module is in communication with the sensor.

9. The system as claimed in claim 2, further comprising a sensor disposed on the sanitizer dispenser operable to assess if sanitizer is dispensed from the first sanitizer dispenser.

10. The system as claimed in claim 9, wherein the compliance module is in communication with the sensor.

11. The system as claimed in claim 2, wherein the compliance module is configured, based on a user identifier, to direct the first sanitizer dispenser to administer at least one of:

(a) a predetermined sanitizer; and (b) a sanitizer amount.

12. The system as claimed in claim 1, wherein the identification apparatus is operable to automatically identify the first sanitizer container engaged with the first sanitizer dispenser, and wherein the sanitizer dispenser operations monitor comprises the consumables-authentication module in communication with the identification apparatus.

13. The system as claimed in claim 12, further comprising an administration computer, wherein the administration computer is notified by the sanitizer dispenser operations monitor if the consumables-authentication module identifies at least one of (a) a second sanitizer container, and (b) an unauthorized sanitizer container.

14. The system as claimed in claim 2, wherein the identification apparatus is further operable to automatically identify the first sanitizer container engaged with the first sanitizer dispenser, and wherein the sanitizer dispenser operations monitor further comprises the consumables-authentication module in communication with the identification apparatus.

15. The system as claimed in claim 14, further comprising an administration computer in communication with the sanitizer dispenser operations monitor of at least the first sanitizer dispenser, the administration computer being operable to generate a compliance report based on at least a portion of the data associated with use of the first sanitizer dispenser, and wherein the administration computer is notified by the sanitizer dispenser operations monitor if the consumables-authentication module identifies at least one of (a) a second sanitizer container, and (b) an unauthorized sanitizer container.

16. The system as claimed in claim 14, wherein the administration computer is in communication with a plurality of sanitizer dispenser operations monitors of a corresponding plurality of sanitizer dispensers, the plurality of sanitizer dispensers including the first sanitizer dispenser, wherein the compliance report is based on data recorded by the plurality of sanitizer dispenser operations monitors.

17. The system as claimed in claim 1, wherein the identification apparatus comprises an RFID reader.

18. A method of monitoring sanitizer use, the method comprising:

automatically obtaining, in conjunction with a first sanitizer dispenser, an identifier associated with a first sanitizer container engaged with the first sanitizer dispenser; and verifying by a computer that the obtained identifier matches a predetermined identifier associated with at least one of a sanitizer type, a sanitizer composition, a sanitizer volume, a sanitizer container shape, a sanitizer container size, and a sanitizer concentration.

19. The method as claimed in claim 18, wherein the user of the first sanitizer dispenser is automatically identified, and wherein the computer records the identity of the user.

20. The method as claimed in claim 19, further comprising monitoring by the computer the use of the first sanitizer dispenser by the user.

21. The method as claimed in claim 20, further comprising preparing a compliance report listing the identity of the user of the first sanitizer dispenser.

22. The method as claimed in claim 19, further comprising determining at least one of a sanitizer type, sanitizer volume, and sanitizer concentration for the user.

23. The method as claimed in claim 19, further comprising compiling a compliance report using data from a plurality of sanitizer dispensers, including the first sanitizer dispenser.

24. The method as claimed in claim 18, wherein the first container engaged with the first sanitizer dispenser is automatically identified, and wherein the computer records the identity of the first sanitizer container.

25. The method as claimed in claim 13, further comprising determining whether the first sanitizer container is approved.

26. The method as claimed in claim 19, wherein the first container engaged with the first sanitizer dispenser is automatically identified, and wherein the computer records the identity of the first sanitizer container.

27. The method as claimed in claim 26, further comprising monitoring by the computer the use of the first sanitizer dispenser by the user.

28. The method as claimed in claim 27, further comprising preparing a compliance report listing the identity of the user of the first sanitizer dispenser.

29. The method as claimed in claim 28, further comprising determining whether the first sanitizer container is approved.

30. A system for monitoring sanitizer use, the system comprising:

means for containing a sanitizer;

means for dispensing the sanitizer to at least one hand of a user;

means for automatically obtaining, in conjunction with the means for dispensing the sanitizer, an identifier associated with the means for containing the sanitizer and corresponding to at least one of a sanitizer type, a sanitizer composition, a sanitizer volume, a sanitizer container shape, a sanitizer container size, and a sanitizer concentration; and means for verifying that the obtained identifier matches a predetermined identifier;

wherein the means for verifying is in communication with the means for automatically obtaining.

31. The system as claimed in claim 30, further comprising means for generating a report using data provided by the means for automatically obtaining and the means for verifying.

32. The system as claimed in claim 30, further comprising a means for indicating whether sanitizer was dispensed.

33. The system as claimed in claim 30, wherein the means for automatically obtaining further comprises at least one of (a) being operatively associated with means for dispensing, and (b) being located proximate to the means for dispensing.

34. The system as claimed in claim 30, further comprising means for verifying that the sanitizer is an approved type.

35. The system as claimed in claim 1, further comprising a consumables replacement module operable to determine that the first sanitizer container associated with the first sanitizer dispense requires replacement in response to passage of a selected amount of sanitizer dispensed.

36. The system as claimed in claim 1, wherein when the consumables replacement module determines that the first sanitizer container requires replacement, the system is rendered inoperable until the first sanitizer container is replaced.

37. The system as claimed in claim 1, wherein the obtained identifier is unique to the first sanitizer dispenser.

* * * * *